US006889836B2

(12) United States Patent
Colloton

(10) Patent No.: US 6,889,836 B2
(45) Date of Patent: May 10, 2005

(54) MEMORABILIA ORGANIZING CONTAINER

(76) Inventor: Maribeth A. Colloton, 16140 Woodstock Ct., Brookfield, WI (US) 53005

( * ) Notice: Subject to any disclaimer, the term of this patent is extended or adjusted under 35 U.S.C. 154(b) by 190 days.

(21) Appl. No.: 10/308,635

(22) Filed: Dec. 3, 2002

(65) Prior Publication Data

US 2003/0116461 A1 Jun. 26, 2003

Related U.S. Application Data

(60) Provisional application No. 60/344,870, filed on Dec. 21, 2001.

(51) Int. Cl.[7] ..... B65D 85/00; B65D 27/00; B42F 15/00

(52) U.S. Cl. ..... 206/425; 229/67.2; 229/67.3; 312/184

(58) Field of Search ..... 206/425, 308.23; 229/67.1–67.4; 312/184

(56) References Cited

U.S. PATENT DOCUMENTS 2,460,909 A * 2/1949 Shaffer ..... 229/67.3
3,424,167 A * 1/1969 Lennartz ..... 312/184
3,724,920 A * 4/1973 Beck ..... 312/184
4,477,013 A * 10/1984 Herrin ..... 229/67.1
4,485,962 A * 12/1984 Farley ..... 229/67.1
5,014,850 A 5/1991 Huff
5,119,950 A 6/1992 Takemura
5,299,688 A * 4/1994 McKay et al. ..... 206/425
5,664,724 A 9/1997 Ho
6,073,944 A 6/2000 Moore
6,626,292 B1 * 9/2003 Huang ..... 206/308.3

* cited by examiner

*Primary Examiner*—Bryon P. Gehman
(74) *Attorney, Agent, or Firm*—Joseph S. Heino; Patrick M. Bergin

(57) ABSTRACT

An apparatus for organizing and retaining memorabilia includes a container having a front wall, a back wall, a pair of side walls and a floor. Insertable within the container is a plurality of folders, each folder having a front wall and a back wall. Each folder may be expandable. Each folder includes an inner pocket defined within it and the inner pocket of each folder may contain one or more slip pockets for holding items therewithin. Each folder may be constructed of a transparent material such that the contents of the folder are visible to the user. Each slip pocket may also be constructed of a transparent material. The container may be constructed of a number of materials and may include a container cover. The container cover may be hinged. The container may include a number of handles attached to or defined within it for assisting with transportation of the container and its contents.

18 Claims, 3 Drawing Sheets

MEMORABILIA ORGANIZING CONTAINER

This application claims the benefit of U.S. Provisional Application No. 60/344,870, filed Dec. 21, 2001.

FIELD OF THE INVENTION

The present invention relates generally to a utility storage container for memorabilia comprised of a plurality of file folders. More particularly, it relates to an apparatus for organizing the plurality of file folders and the contents thereof for quick and easy retrieval.

BACKGROUND OF THE INVENTION

This inventor is familiar with numerous devices and systems that are intended to be used for information storage. Throughout the history of the printed word, and the development of art, use of the either artistic media or print media has created an immediate need for storage of the documents containing those words and images. Sometimes, however, it is not the images or the words of the documents themselves that need storage, but the memories of another time or place that they bring their owner back to. The device of the present invention provides an easy and effective storage mechanism to preserve those memories.

In order to meet the demand created by this need to store documents, inventors have developed devices such as folders, expandable files, briefcases and even wheeled folders. One of the major drawbacks of every device of which the inventor is aware is that prior storage devices fail to effectively accommodate items of different sizes.

In the experience of the inventor, parents and grandparents often wish to recapture memories of their children's and grandchildren's school years by saving relevant mementos from that period of time.

Specifically, this inventor, herself a parent, is aware that schoolchildren complete voluminous amounts of schoolwork for each year of school, participate in plays and music programs that are memorialized by programs, audiotapes and videotapes, receive report cards, get school pictures and yearbooks, are featured in newspapers and, in general, produce a lot of miscellaneous memorabilia during each year of their schooling.

In the experience of the inventor, parents, as well as their older children, often wish to keep some memorabilia recording the experiences of their own or their children's experiences in order to help them to recapture the moment. Also in the experience of the inventor, previous storage devices are unacceptable primarily because of their failure to accommodate both large items such as artwork and small items such as floppy disks. Additionally, some types of documents, such as report cards and theatre programs, need extra care to prevent loss or damage.

SUMMARY OF THE INVENTION

Accordingly, a primary objective of the device of the present invention is to provide an apparatus for storing documents and memorabilia of many different shapes and sizes within a segment of a larger storage unit. A second objective is to provide an easily storable organization system that will fit in a normal-sized closet so that the system is both accessible and storable. Yet another objective of the present invention is to provide a waterproof, crush resistant exterior for the organization system. A fourth objective is to provide a design for optimal organization including segmented and tabbed products with labeling options. Yet another objective is to provide an organizational system that will work with a multitude of alternative uses including scrapbooking, wedding planning, bridal remembrance and sewing, to name a few, and for particular professionals including teachers, seamstresses, and others.

In accordance with the aforementioned objectives of the invention, there is provided a rigid container large enough to accommodate a preschool-aged child's artwork. Within the preferred embodiments of the rigid container a plurality of organizing segments, or pockets, is included. Each segment includes a plurality of smaller, translucent envelopes of various sizes attached to the sides of the segments for storage of items that could be damaged, lost or confused if stored in the general storage space. The foregoing and other features of the apparatus of the present invention will be apparent from the detailed description that follows.

DETAILED DESCRIPTION

Figure 1:
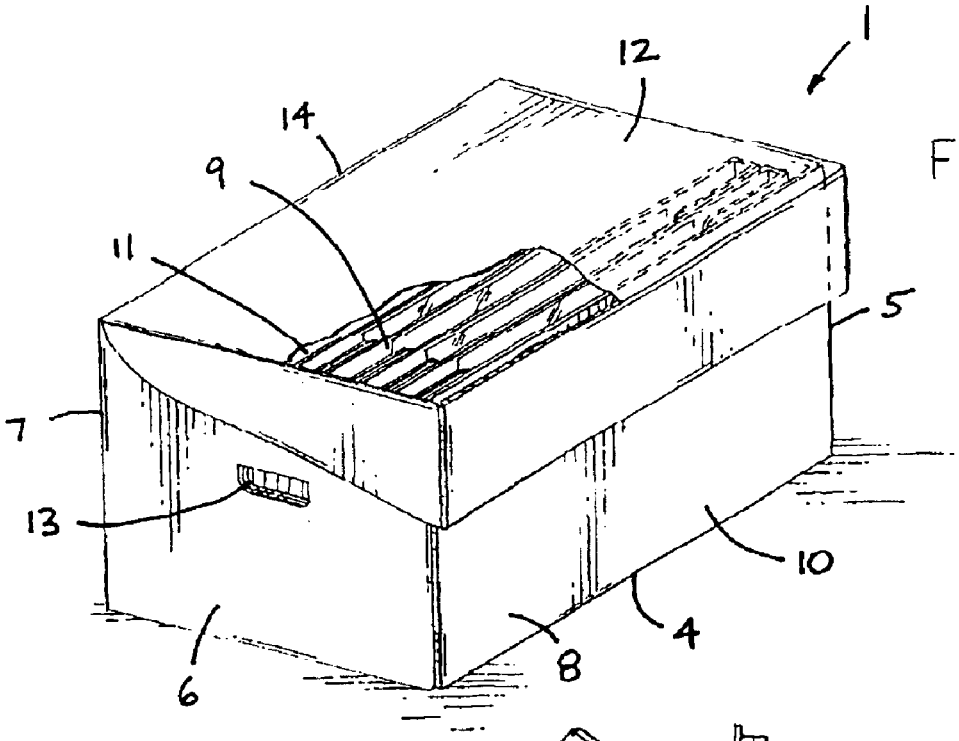
FIG. 1 is a front, top and left side perspective view of a preferred embodiment of the device of the present invention with a portion of the hinged top, or cover, of the device shown in cutaway and further showing the segmented storage area folders, or inserts, contained therewithin.

Referring now to the drawings in detail, wherein like numbered elements refer to like elements throughout, FIG. 1 illustrates one embodiment of a storage device, generally identified 1, constructed in accordance with the present invention. This embodiment of the present invention calls for a generally rectangular and rigid container 10 constructed of cardboard or other sturdy fiberboard material and including an integrally formed hinged top or cover 12. The hinge 14 of the cover 12 may be integrally formed with the vertical back wall 7 of the container 10. In addition to the back wall 7, the container 10 also includes a vertical front wall 8, a pair of vertical side walls 5, 6 and a floor 4.

The uppermost portion of the side, back and front walls 5, 6, 7, 8 form an opening 9 to the interior 11 of the container 10. It is to be understood that any suitably rigid material may be used with this particular embodiment and still come within the scope of this invention. With this configuration, the contents of the storage device 1 may be readily and easily accessed and exposed through the opening 9 as such is desired or required. The storage device 1 of the present invention also features handles 13 for easy lifting and transporting of the device 1. As shown, one handle 13 is located within each vertical side wall 5, 6.

Figure 2:
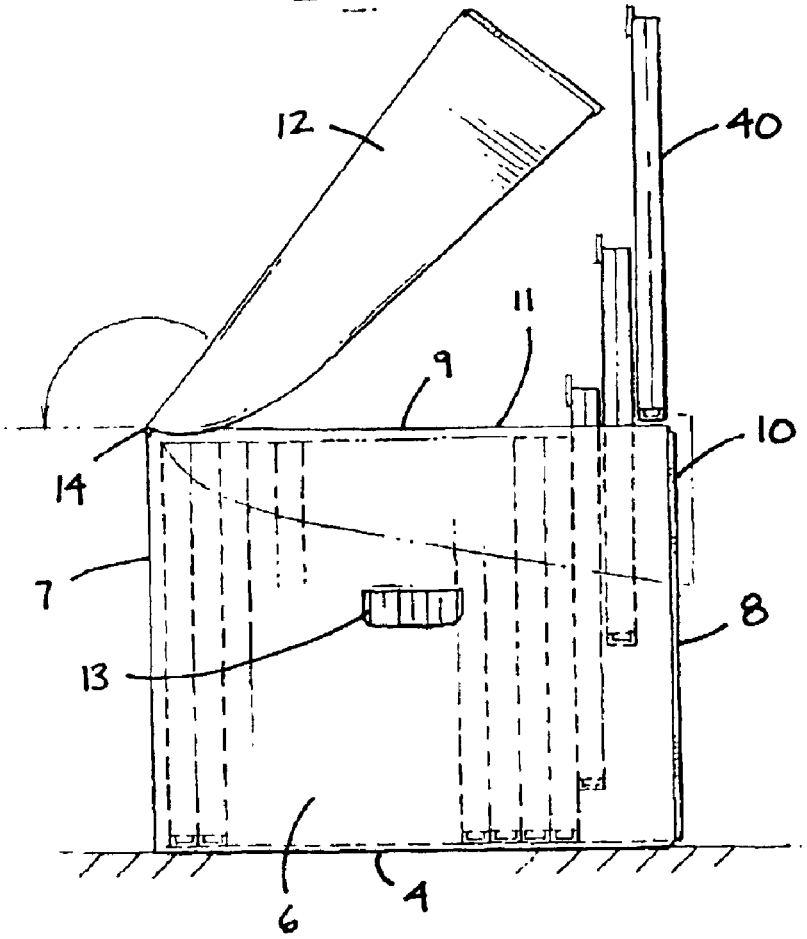
FIG. 2 is a left side elevational view of the device shown in FIG. 1 and showing the hinged top, or cover, in the open position and the segmented folders, or inserts, in various states of removal.

The interior 11 of the storage device 10 provides adequate space for holding a plurality of insert folders 40, typically between 12 and 15 such folders 40 therein. See FIG. 2. More or less of such insert folders 40 could be accommodated depending on the size of the insert folders 40 when they are filled and the size of the container 10 holding them, size not being a limitation of the device 1.

Figure 6:
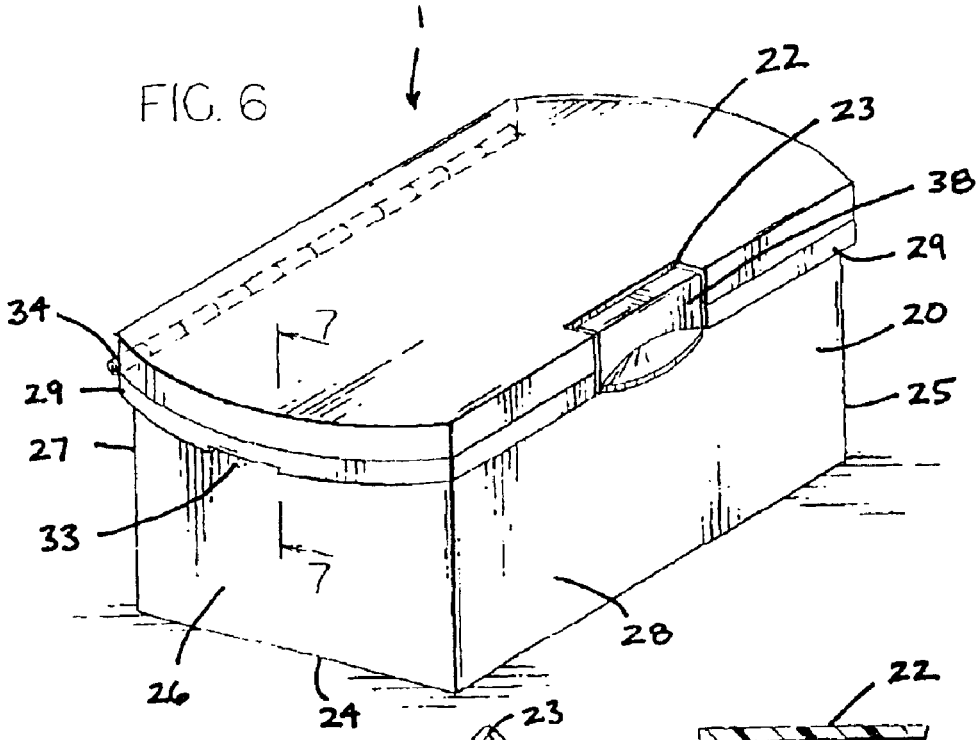
FIG. 6 is a front, top and left side perspective view of an alternative embodiment of the device of the present invention that employs a rigid plastic container for the organization system.
Figure 7:
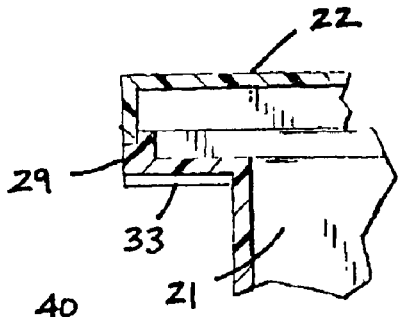
FIG. 7 is an enlarged cross-sectioned side view taken along line 7—7 of FIG. 6.

As shown in FIG. 6, an alternative embodiment of the storage device 1 of the present invention is illustrated that is made of a moldable plastic material. Here again, the use of plastic, fiberglass or any other similar material is not a limitation of the device of the present invention. Such construction, however, does allow the plastic container 20 to offer several more features than its cardboard counterpart 10 including inset handles 33, a waterproof exterior formed from continuous side walls 25, 26, 27, 28 and bottom 24, a container lip 29 for engaging the edge of the cover 22 about its perimeter for additional protection from outside elements, and a latch 38 for securing the top 22 at a front portion 23 of the top 22 opposite the hinge 34. See FIG. 7. Clearly, this plastic alternative embodiment 20 of the storage device 1 offers more durability and longevity than its cardboard counterpart 10.

Figure 8:
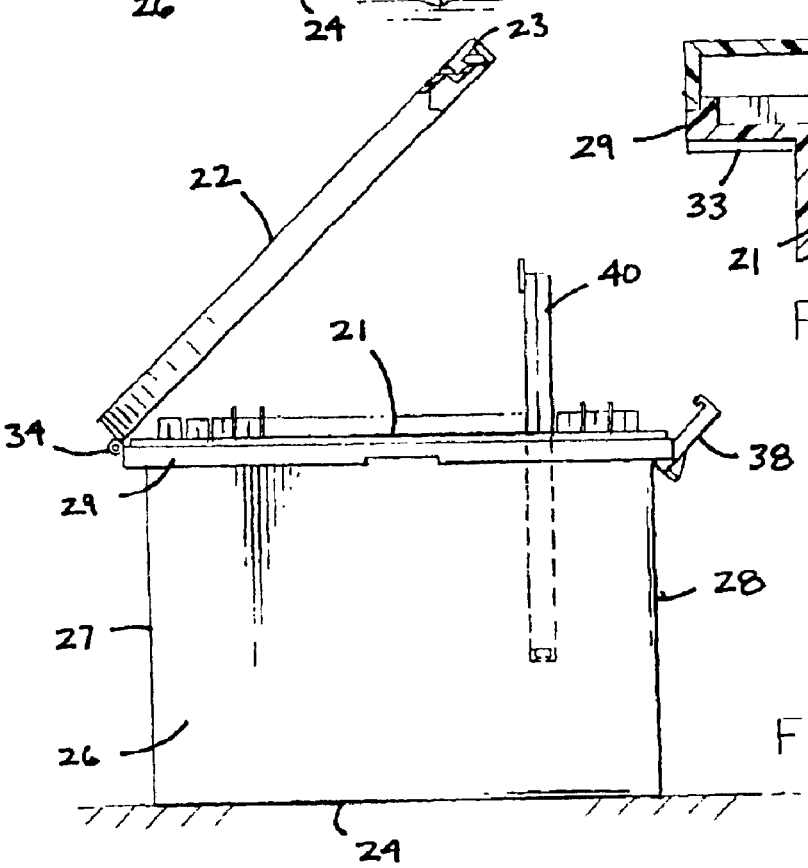
FIG. 8 is a left side elevational view of the device shown in FIG. 6 and showing the hinged top, or cover, in the open position.

Within either embodiment of the containers 10, 20 are a plurality of insert folders 40. See FIGS. 2 and 8. The containers 10, 20 of the present invention are designed to accommodate as many insert folders 40 as, for example, the number of years of schooling of a child. Here again, the number of such insert folders 40 is not a limitation of the invention.

Figure 3:
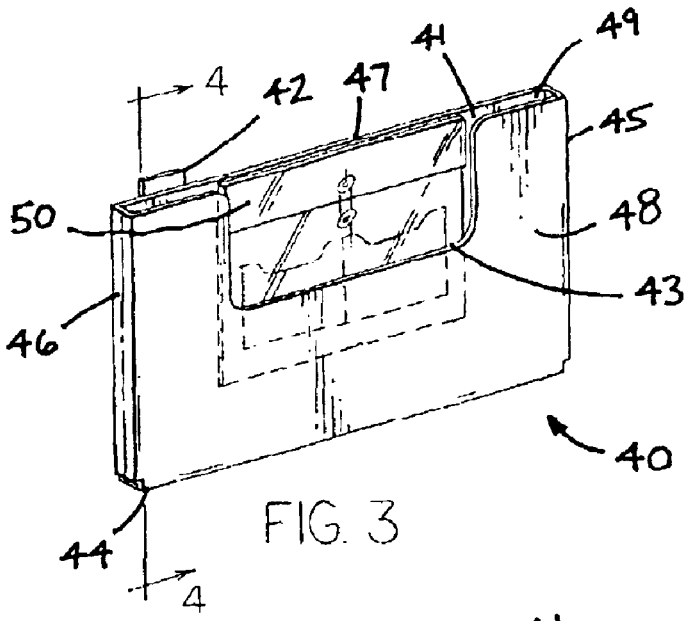
FIG. 3 is a front, top and left side perspective view of one of the segmented folders, or inserts, shown in FIG. 2.
Figure 4:
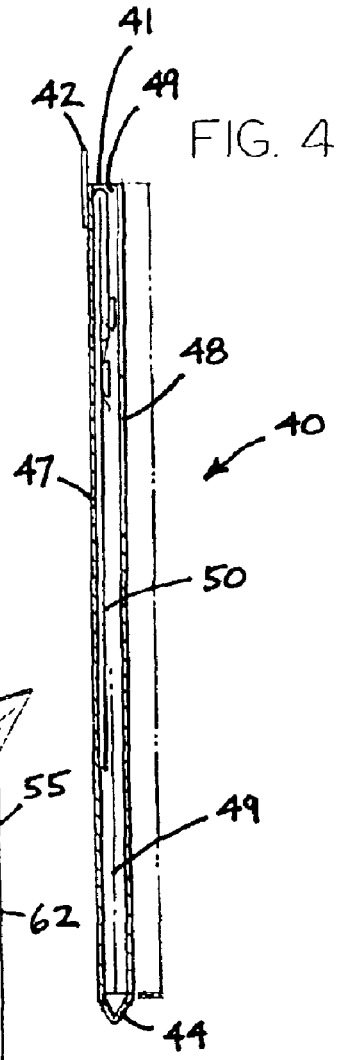
FIG. 4 is an enlarged side elevational and cross-sectioned view of the folder, or insert, shown in FIG. 3 and taken along line 4—4 thereof.

Referring now to FIGS. 3 and 4, it will be seen that each insert folder 40 has a front wall 48 and a back wall 47. Connecting the sides and bottoms of the front and back walls 47, 48 are expandable sides 45, 46 and an expandable bottom 44. In this fashion, each insert folder 40 can hold a wide variety of differently sized articles as previously described. Each insert folder 40 has several other features making the storage of memorabilia both easy and organized. For example, each insert folder 40 features a tab 42 suitable for labeling the insert folder's 40 contents. The tab 42 may be attached at any point along the upper opening 49 of the insert folder 40. A number of such tabs 42 could be staggered relative to one another when viewed from the front of the container 10, 20 to aid in quick recognition of the folder contents. The front wall 48 of each insert folder 40 also includes a front wall recess 43 that allows increased visualization of the inside portion 41 of the insert folder 40 and the contents thereof.

Figure 5:
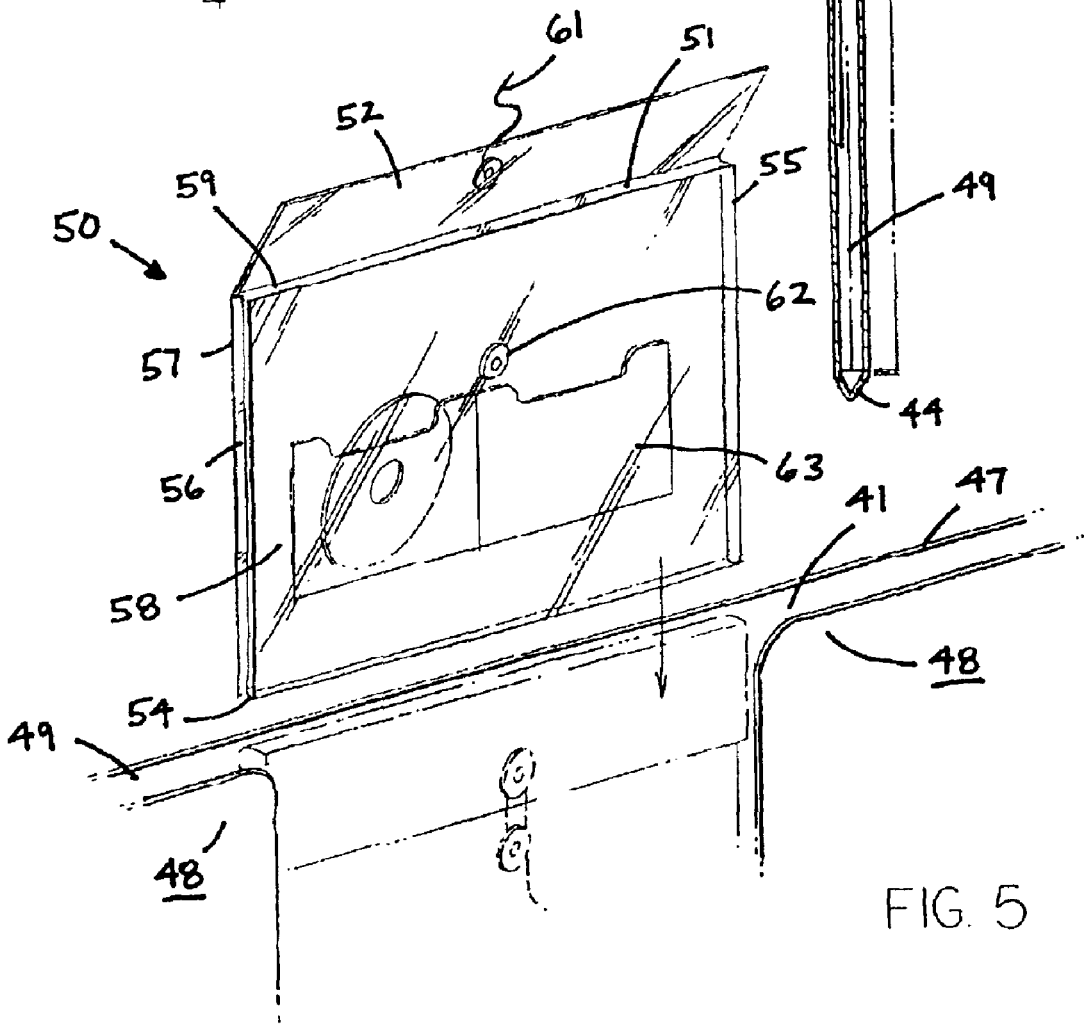
FIG. 5 is a further enlarged front, top and left side perspective view of one of the segmented folders, or inserts, showing the closure mechanism and the two smaller pockets that are a part of the segmented folder.

Each insert folder 40 also features an expandable inner pocket 50. See FIG. 5. In the preferred embodiment, this inner pocket 50 is constructed of a transparent plastic material such that the contents of the inner pocket 50 may be easily viewed. As previously described, it is also optimum that the inner pocket 50 be positioned within the insert folder 40 such that the pocket is easily visualized by virtue of the front wall recess 43 that is formed within the front wall 48 of the insert folder 40. This inner pocket 50 similarly includes a front wall 58, a back wall 57 and a pair of expandable side walls 55, 56 and an expandable bottom wall 54. In the preferred embodiment of the present invention, the back wall 57 is affixed to the innermost portion of the back wall 47 of the insert folder 40 by any suitable means. Affixed to or formed integrally with the pocket back wall 57 is a pocket flap 52 for securing the pocket opening 59 and the pocket contents 51. Each pocket 50 also includes several smaller slip pockets 63 of varying sizes designed to store smaller items such as report cards, computer disks and school pictures. In one embodiment, the inner pocket 50 could include additional pockets 63, for example, that are 10"×12" down to pockets small enough to accommodate 3.5" inch floppy disks, or smaller. The inner pocket 50 also features a cover 52 having a string 61 that can encircle a stud 62 located on the front wall 58 of the inner pocket 50 to secure the contents 51 thereof.

Although the foregoing has been described with a certain degree of particularity, it is to be understood that the present disclosure has been made by way of example only and that numerous changes in the construction and the arrangement of components, some of which have been alluded to, may be resorted to without departing from the spirit and scope of the invention as it is described. It is also to be understood that contemplated or anticipated use of the device 1 is not a limitation insofar as many uses for this assembly could be made as such is desired or required by the user.

From the foregoing detailed description of the illustrative embodiment of the invention set forth herein, it will be apparent that there has been provided a new, useful and uncomplicated device for storing the memorabilia of a child or of a wedding in an organized fashion, which may be used and reused, can be conveniently stored, provides several differently sized folders and pockets for different materials and offers easy accessibility to memorabilia of earlier times.

What is claimed is:

1. An apparatus for organizing memorabilia, such memorabilia comprising a wide variety of differently sized items, which apparatus comprises a container having a generally vertical back wall, a generally vertical front wall, a pair of generally vertical side walls, and a floor, each wall having an uppermost portion and the uppermost portion of the side, back and front walls forming an opening to the interior of the container, a plurality of substantially flat insert folders, each insert folder being dimensioned for placement within the container and for receiving a wide variety of the differently sized items, and each insert folder having a front wall and a back wall, the front wall and the back wall forming an inner portion of the insert folder, and an inner pocket secured to the back wall of each insert folder, the inner pocket being disposed within the inner portion of the insert folder, each inner pocket similarly having a front wall and a back wall and being dimensioned significantly smaller than the front and back walls of the insert folder for receiving document sized items and small sized items and being constructed of a substantially transparent material such that the contents of the inner pocket may be visualized, and wherein the front wall of each insert folder further includes a recess defined within the front wall, and wherein the inner pocket of each insert folder is secured to the back wall of each insert folder in a position that is behind the front wall recess for increased visualization of the inner portion of the insert folder and of the inner pocket secured therewithin.

2. The apparatus of claim 1 wherein the container is comprised of a generally rectangular and rigid container.

3. The apparatus of claim 2 wherein the container is constructed of cardboard or other sturdy fiberboard material.

4. The apparatus of claim 2 wherein the container is constructed of a moldable plastic or fiberglass material.

5. The apparatus of claim 1 wherein the container includes an integrally formed hinged top or cover.

6. The apparatus of claim 5 wherein the container includes a container lip forming a substantially continuous perimeter about the uppermost wall portions and the cover includes a substantially continuous cover edge whereby the container lip is functionally adapted to sealingly engage the perimeter of the container lip for additional protection from outside elements.

7. The apparatus of claim 5 including at least one latch for securing the container cover to an uppermost wall portion of the container.

8. The apparatus of claim 1 wherein the container includes one or more handles attached to the container or defined within the container for lifting and transporting the container and its contents.

9. The apparatus of claim 1 wherein the container walls and floor form a continuous and waterproof exterior.

10. The apparatus of claim 1 wherein the front wall and the back wall of each insert folder are connected together by means of expandable side walls and an expandable bottom whereby the insert folder can retain certain memorabilia therewithin.

11. The apparatus of claim 1 wherein each insert folder includes a tab for labeling the folder's contents.

12. The apparatus of claim 11 wherein the tabs of adjacent insert folders are staggered for easy recognition of folder contents.

13. The apparatus of claim 1 wherein each inner pocket includes a back wall, a front wall, a pair of expandable side walls and an expandable bottom wall whereby the inner pocket can retain the document sized and small sized items of memorabilia therewithin.

14. The apparatus of claim 13 wherein each inner pocket includes an inner pocket flap, the inner pocket flap being integrally formed as part of the inner pocket back wall for securing the inner pocket contents.

15. The apparatus of claim 14 wherein each inner pocket flap includes a flap retention means.

16. The apparatus of claim 1 wherein each inner pocket includes a front wall and one or more smaller slip pockets secured to the inner pocket front wall whereby the slip pocket can retain the small sized items of memorabilia therewithin.

17. The apparatus of claim 16 wherein the slip pocket of each inner pocket is secured to the front wall of the inner pocket and is constructed of a transparent material whereby the contents of the slip pocket may be easily visualized.

18. The apparatus of claim 17 wherein at least one of the slip pockets is configured for retaining a computer-readable disk therewithin.

* * * * *